US009222651B1

(12) United States Patent
Vlad et al.

(10) Patent No.: US 9,222,651 B1
(45) Date of Patent: Dec. 29, 2015

(54) MODULAR LED LIGHT FIXTURE

(71) Applicants: Laurentiu O. Vlad, Niles, IL (US); Christopher J. Ferguson, Santa Claus, IN (US)

(72) Inventors: Laurentiu O. Vlad, Niles, IL (US); Christopher J. Ferguson, Santa Claus, IN (US)

(73) Assignee: LUMINII CORP., Morton Grove, IL (US)

( * ) Notice: Subject to any disclaimer, the term of this patent is extended or adjusted under 35 U.S.C. 154(b) by 0 days.

(21) Appl. No.: 14/607,216

(22) Filed: Jan. 28, 2015

(51) Int. Cl.

| | |
|---|---|
| ***F21V 1/00*** | (2006.01) |
| ***F21V 11/00*** | (2015.01) |
| ***F21V 19/00*** | (2006.01) |
| ***F21V 29/76*** | (2015.01) |
| ***F21K 99/00*** | (2010.01) |
| ***F21V 23/02*** | (2006.01) |
| *F21Y 101/02* | (2006.01) |

(52) U.S. Cl.
CPC ..... *F21V 19/001* (2013.01); *F21K 9/50* (2013.01); *F21V 23/023* (2013.01); *F21V 29/76* (2015.01); *F21Y 2101/02* (2013.01)

(58) Field of Classification Search
CPC ..... F21K 9/50; F21K 9/30; F21K 9/135; F21Y 2103/003; F21V 13/04
USPC ..... 362/294, 373, 235, 249.01, 217.12, 362/218, 225
See application file for complete search history.

(56) References Cited

U.S. PATENT DOCUMENTS

| | | | | |
|---|---|---|---|---|
| 7,926,985 | B2 * | 4/2011 | Teng et al. | 362/373 |
| 8,696,157 | B2 | 4/2014 | McClellan | |
| 8,714,771 | B2 * | 5/2014 | Nishimori et al. | 362/217.12 |
| 8,888,306 | B2 * | 11/2014 | Thomas et al. | 362/92 |
| 2012/0195049 | A1 | 8/2012 | Chou et al. | |
| 2013/0058076 | A1 | 3/2013 | Ni | |
| 2013/0208457 | A1 | 8/2013 | Durkee et al. | |
| 2014/0126197 | A1 | 5/2014 | Dixon et al. | |

FOREIGN PATENT DOCUMENTS

CA 2765289 A1 7/2013

OTHER PUBLICATIONS

Webpage, Alibaba.com, "T8 led lens cover with bottom extrusion and lamp holders," <http://www.alibaba.com/product-detail/T8-led-lens-cover-with-bottom_884376621.html>, accessed Jul. 7, 2014.

(Continued)

*Primary Examiner* — Anh Mai
*Assistant Examiner* — Jessica M Apenteng
(74) *Attorney, Agent, or Firm* — Stiennon & Stiennon

(57) ABSTRACT

An LED light fixture has an extruded base housing element defining an opening which is removably bridged by a metal heat sink to which is mounted at least one LED. A plastic cover lens has deflectable legs with axial concave elements which engage with outwardly facing convex elements on cover mount members which protrude from the heat sink on either side of the LED. The LED power supply may be supported in a compartment above the heat sink. The cover lens has a wrap-around connection to the heat sink cover mount members which is tolerant of variation in heat sink extrusion dimensions, and which is insensitive to variations in main housing element dimensions. Alternative trim elements and cover lenses allow field configuration of the fixture to various applications.

21 Claims, 2 Drawing Sheets

(56) References Cited

OTHER PUBLICATIONS

Webpage, Farwise Technology Co., Ltd, "T9 PC Plastic extrusion LED tube shell LED lamp cover shade," <http://farwise.cn/product/1901283953-219019213/PC_Plastic_extrusion_T9_LED_Tube_Shell_LED_Lamp_Cover_Shade.html>, accessed Jul. 7, 2014.

Webpage, Amazon.com "1M/3.3 ft U-Shape Aluminum Channel—LED Aluminum Extrusion for flex/hard LED Strip Light w/Oyster White cover-U02," <http://www.amazon.com/3-3ft-U-Shape-Aluminum-Channel-Extrusion/dp/B00F9Q602M>, accessed Jul. 7, 2014.

Brochure, Axis Lighting Inc., BEAM3 LED Recessed Mount, Apr. 2, 2014.

Brochure, Focal Point, LED SEEM ® 4, www.focalpointlights.com, before May 30, 2014.

AEC (Aluminum Extruders Council) White Paper: Aluminum Extrusion Use in LED Lighting Fixtures. http://aec.org/pdfs/WhitePapers/AEC_LED_White_Paper_041614.pdf?utm_source=AEC+Leads&utm_campaign=a722262876-LED+White+Paper+%2B+BC_Webinar+22Apr2014&utm_medium=email&utm_term=0_60a88f4195-a722262876-407035221, accessed Jan. 28, 2015.

Webpage, Ledridge Lighting, LED Extrusion, <http://www.ledridge.co.uk/led-extrusion>, accessed Sep. 24, 2014.

Webpage, DIYTrade, 30W 36W washwall light components wallwasher LED aluminum extrusion heat sink, <http://www.diytrade.corn/china/pd/11875049/30W_36W_washwall_light_components_wallwasher_LED_aluminum_extrusion_heat_sink.html>, accessed Sep. 24, 2014.

* cited by examiner

MODULAR LED LIGHT FIXTURE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to light fixtures in general, and more particularly to light fixtures involving light emitting diodes (LEDs).

LED light sources offer significant advantages over incandescent lights in terms of energy efficiency and useful lifetime. The LEDs can be provided in continuous strips of diodes which enable mounting within compact light fixtures which may be utilized in a wide range of applications. LED performance is temperature dependent, and can suffer at elevated temperatures. LED light fixtures thus often make use of passive heat sinks to dissipate the heat generated internally. Because the strip of individual LEDs which serves as the LED fixture's light source is comprised of multiple point sources, the fixture is commonly provided with an extruded plastic diffuser or cover lens which attaches to an extruded aluminum housing which holds the LED strip. Sometimes the housing itself acts as the heat sink for the LEDs.

Retention of the cover lens in place on the fixture is an important aspect of an LED light fixture. If the cover lens is too loose, it runs the risk of separating from the light fixture, often located overhead. If it is too tight, it can be difficult to remove for servicing. Many LED fixtures with extruded housings attach the cover lens by disposing outwardly extending portions of deflectable legs of the cover lens within inwardly facing slots or grooves of the main housing. However, with the typical tolerances of extrusion manufacture, if this connection is not tight enough, the cover lenses can fall off the fixtures. Moreover, because forces are applied to the housing itself when the cover lens is removed or reinstalled during service, this lateral movement on the main housing risks cracking in the drywall within which a fixture is mounted, especially where the fixture is mudded in place.

Furthermore, light fixtures can be mounted in many fashions, flush to the surface of a wall ceiling or floor, in hung ceilings or drywall ceilings, suspended, mounted to project from a wall or ceiling, for downlighting, uplighting, or wash lighting, and in other fashions. Minimizing the number of distinct parts to accommodate all these options is an important objective. In addition, construction projects are often subject to change, and pose a logistical challenge to fixture suppliers to provide light fixtures of the right type and size to suit the needs of the moment.

What is needed is an LED light fixture that securely retains its cover lens while permitting convenient servicing with little risk of cracking drywall installations, and which has wide variability of installation mode with a minimum of parts.

SUMMARY OF THE INVENTION

The LED light fixture of the present invention provides a heat sink which bridges an opening in a base housing element and which is removably fastened to the housing element to control the spacing of the base housing element's side members. A plastic cover lens has deflectable legs with axial concave elements which engage with outwardly facing convex elements on cover mount members which protrude from the heat sink on either side of the LED strips. The LED power supply may be supported in a compartment above the heat sink. The cover lens thus has a wrap-around connection to the heat sink cover mount members which is tolerant of some variation in heat sink extrusion dimensions, and which is totally insensitive to variations in main housing element dimensions. The main housing element accepts various trim pieces, and the heat sink accepts a variety of lenses and lens covers which are interchangeable in the field, even after the main housing element has already been installed. End caps are provided which allow finished fixtures of any desired length to be readily formed in the field by cutting to length the base housing element and cover lenses.

It is an object of the present invention to provide an LED light fixture having cover lenses which are securely attached yet readily removed as needed.

It is another object of the present invention to provide an LED light fixture which can be readily configured in the field for different lighting applications.

Further objects, features and advantages of the invention will be apparent from the following detailed description when taken in conjunction with the accompanying drawings.

DESCRIPTION OF THE PREFERRED EMBODIMENTS

Figures 1, 5, 6:
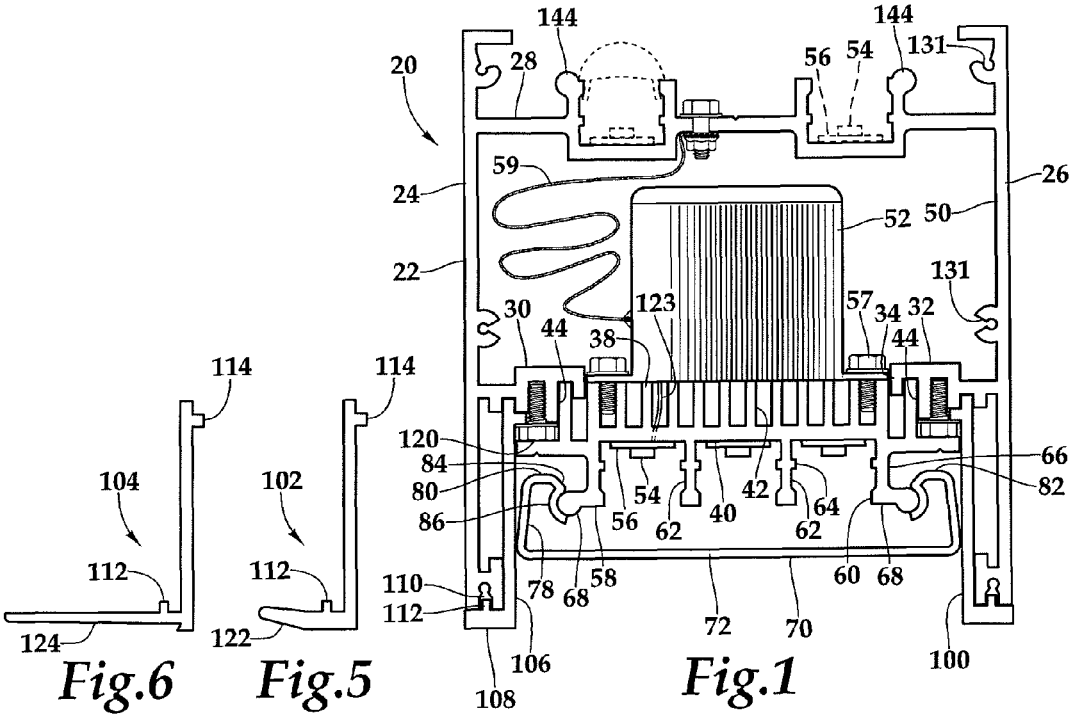
FIG. 1 is an end view of an LED light fixture of this invention.
FIG. 5 is an end view of a flanged trim piece for use in an LED fixture of this invention.
FIG. 6 is an end view of a mud-in trim piece for use in an LED fixture of this invention.

Referring more particularly to FIGS. 1-7, wherein like numbers refer to similar parts, an LED light fixture 20 is shown in FIG. 1. The fixture 20 employs a modular construction which allows it to be readily configured in the field for many alternative applications with a few alternative components. All the configurations begin with an extruded aluminum base housing element 22. The base housing element 22 is of constant cross section and may be extruded to any desired length, and is readily cut down to size in the field to match the exact dimensions of the site where it is being installed. The base housing element 22 may be, for example, about 3 and ⅝ inches wide, and about 3 and ⅞ inches tall.

Figure 2:
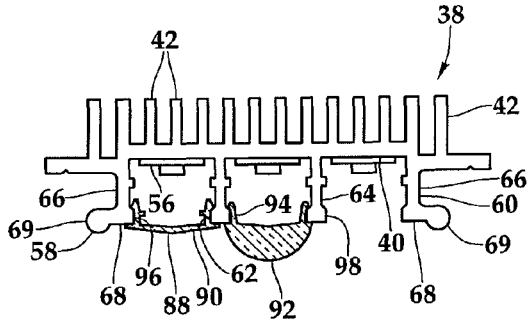
FIG. 2 is an end view of a heat sink of the fixture of FIG. 1, with LEDs mounted thereto, and various lens options over the LEDs.
Figure 4:
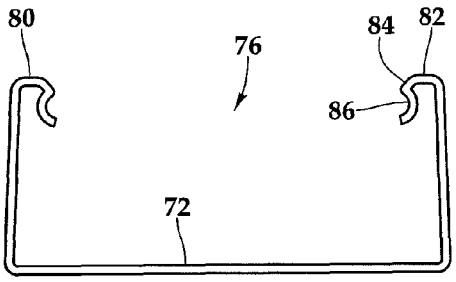
FIG. 4 is an end view of a drop cover lens for use in an LED fixture of this invention.
Figure 3:
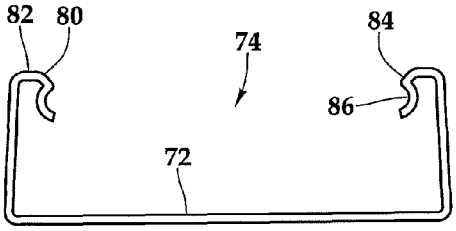
FIG. 3 is an end view of a flush cover lens for use in an LED fixture of this invention.

The base housing element has a first side member 24 which is joined to a second side member 26 by a top member 28. A first connecting flange 30 extends inwardly from the first side member 24, and a second connecting flange 32 extends inwardly from the second side member 26 towards the first connecting flange. The connecting flanges may be positioned about 2 and ⅜ inches from the top of the base housing element. A first opening 34 is defined between the interior margins 36 of the connecting flanges. As shown in FIG. 2, a heat sink 38 is formed as another extruded aluminum part with constant cross section. The heat sink 38 has a mounting segment 40 extending horizontally and an array of parallel heat radiating fins 42 that extend upwardly in the direction of the top member 28.

Figure 7:
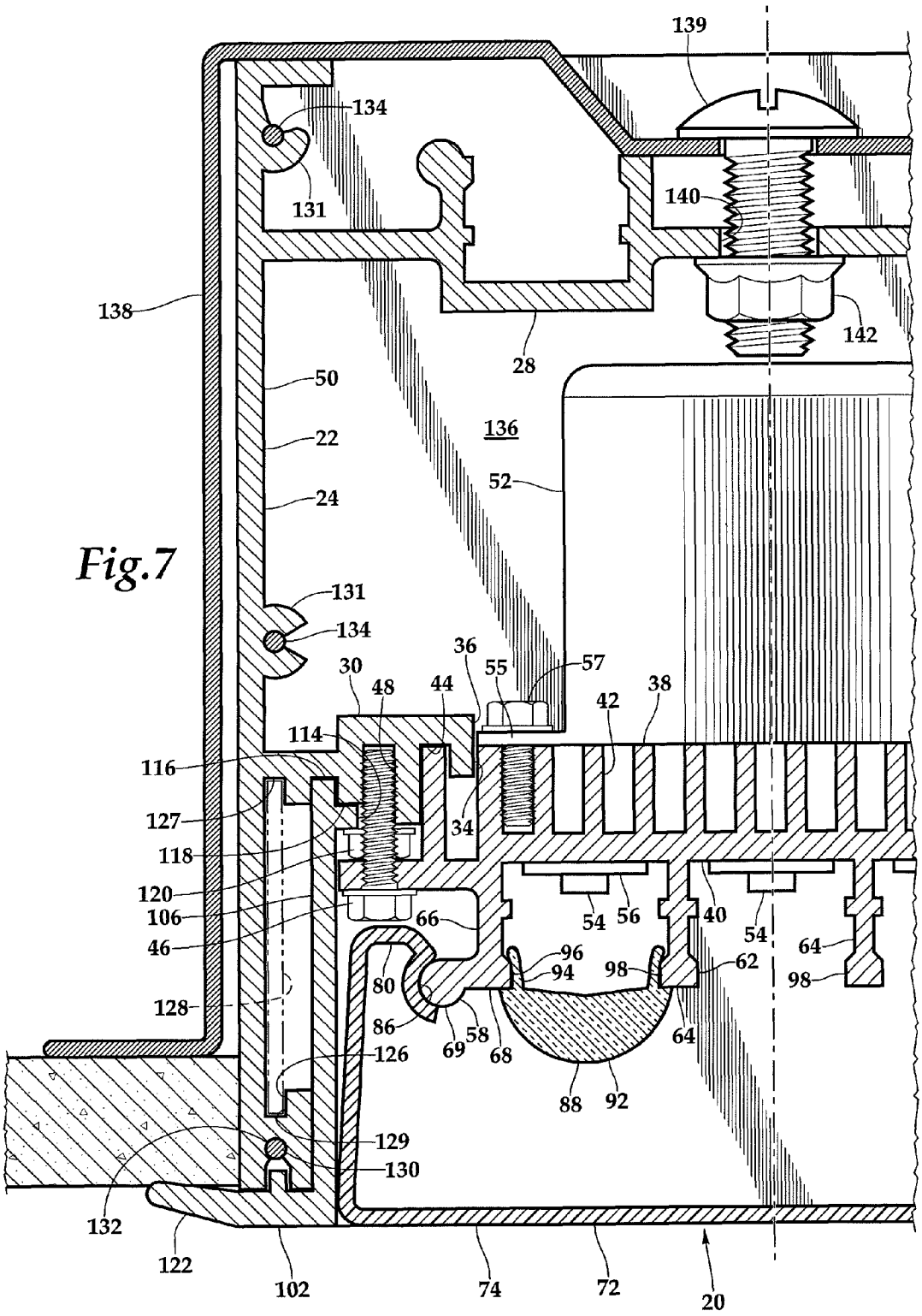
FIG. 7 is a fragmentary cross-sectional view of an LED fixture of this invention installed in a drywall opening.

Each connecting flange 30, 32 has a downwardly opening slot 44 spaced outwardly from a flange interior margin 36. One of the heat sink fins 42 is received within each of these slots 44, as shown in FIG. 1. The heat sink 38 is then releasably secured to the base housing element 22 by fasteners 46, as shown in FIG. 7, which extend through the heat sink and engage within downwardly facing fastener slots 48 formed in the connecting flanges 30, 32. It will be observed that the base housing element extrusion 22, because of its larger size, is prone to dimensional variation as a consequence of the manufacturing process. In particular, the side members 24, 26, which extend a significant distance from their point of connection at the top member 28, are prone to being more or less close together at their most remote ends. The compact and smaller size of the heat sink 38 means that its side to side dimensions are better controlled. Hence, the heat sink 38, when inserted across the first opening 34 effectively controls the spacing between the first side member 24 and the second side member 26 of the base housing element 22.

With the heat sink 38 fastened in place, an interior compartment 50 is defined within the base housing element 22 between the top member 28 and the heat sink which extends for the length of the fixture 20 and which provides a volume within which to receive one or more LED power supplies 52. The power supply 52 will usually be connected to a source of mains power (not shown), and will include an AC to DC converter so as to provide direct current power to the LEDs 54 which are the light sources of the fixture 20. An electrical cable 123 connects the power supply to the LEDs 54, as shown in FIG. 1. The cable 123 may pass through a hole drilled in the heat sink 38. The power supply 52 may be provided with sidewardly projecting flanges 55 which overlie the fins 42 of the heat sink 38. Fasteners 57 extend through the flanges 55 into a groove between two fins of the heat sink 38. A flexible cable lanyard 59 is preferably secured to the assembly of the power supply 52 and the heat sink 38. The lanyard 59 serves to retain the assembly of the power supply and the heat sink associated with the housing, to retain overhead control of the assembly, prevent it falling free of the housing when the fasteners that hold it in place are removed to permit servicing of the fixture.

As shown in FIG. 2, the LEDs 54 are preferably provided as a strip 56 of many axially aligned LEDs affixed to an axially extending substrate which is glued to the mounting segment 40 of the heat sink 38 facing downwardly. The heat sink 38 has a first cover mount member 58 and a second cover mount member 60 which extend downwardly from the mounting segment on either side of the LED strip 56. Multiple LED strips 56 may be provided, each in a channel 62 separated from the others by intermediate walls 64. As shown in FIGS. 2 and 7, each cover mount member 58, 60 has a downwardly extending leg 66 and a foot 68 which extends sidewardly from the leg, such that the feet project away from one another. Each foot has a sidewardly protruding convex element 69, preferably a portion of a cylinder, for example about 270 degrees of a narrow cylinder.

The cover mount members 58, 60 engage with a plastic cover lens 70 to retain it securely but releasably to the heat sink 38. The cover lens 70 has a lens element 72 which allows light from the LEDs to escape the fixture. The cover lens 70 may be transparent, frosted, or colored and may serve to diffuse the light of the individual LEDs. The cover lens 70 protects the LEDs from dust and environmental material, and also serves a decorative purpose as it is the appearance feature of the fixture which is chiefly visible, in particular when the LEDs are not illuminated. The cover lens 70 controls the characteristics of the light which is shed by the fixture. It may be extruded from a plastic resin which is an acrylic blend. For example, DR101, a flexible clear acrylic, may be blended with V045, an optically clear acrylic, to yield a flexible part resistant to breaking as it is bent, yet which is clear and energy efficient in transmitting emitted light, and resistant to deterioration when exposed to ultraviolet light. DR101 is a transparent high impact and heat resistant Poly(Methyl Methacrylate) Acrylic. V045 is a thermoplastic acrylic resin.

The fixture 20 may accommodate cover lenses of various sizes to achieve a desired surface treatment of the fixture. The shallowest cover lens 70, shown in FIG. 1, is a regress cover lens, in which the lens element 72 is recessed within the fixture. A deeper cover lens is the flush cover lens 74, shown in FIGS. 3 and 7, which has a flush finish, and an even deeper cover lens is the drop cover lens 76 shown in FIG. 4, which projects below the base housing element.

Because the light fixture can be as much as eight feet long, or even longer, it is important that the cover lens 70 is securely retained within the fixture, lest it fall from an overhead position. At the same time, it should be readily removed for servicing the fixture without disturbing the installation of the fixture 20, particularly in applications where it is mudded into drywall or tile, where inordinate stress on the housing might crack or disturb the surrounding drywall or tile. The mechanism for retaining the cover lens to the heat sink is a resilient engagement between the flexible cover lens 70 and the rigid cover mount members 58. All the cover lens embodiments 70, 74, 76 have similar attachment mechanisms although they may vary in proportions.

As shown in FIG. 7, the flush cover lens 74 has two arms 78 which extend upwardly from and are joined by the lens element 72. It will be observed that the corners where the arms 78 join the lens element 72 preferably are advantageously free of reinforcing structural elements or outwardly projecting flanges that would cast a shadow within the lens or otherwise detract from an even illumination of the lens element 72. Each arm 78 has a connecting member 80 which engages one of the heat sink cover mount members 58, 60. The connecting member 80 may be comprised of a first flange 82 which extends inwardly from the cover arm 78 joined to an inlet ramp 84 which extends inwardly and back towards the lens element 72, and a concave element 86 joined to the inlet ramp which opens sidewardly towards the convex element 69 of the heat sink foot 68. The concave element 86 may preferably define a segment of a cylinder, for example somewhat less than 180 degrees, for example preferably between 102 to about 132 degrees, and most preferably about 122 degrees, that mates with the cylindrical convex portion 69 of the cover mounting foot 68. Thus the cover lens 74 is pressed into place so that the inlet ramps 84 engage the rigid cover mount members 58, 60 on the heat sink, thereby deflecting the arms 78 outwardly, until the concave elements 86 of the connecting members 80 snap into place on the convex elements 69 of the cover mount members. This sideward deflection of the arms securely retains the cover lens 74 to the heat sink. Yet, the cover lens 74 is readily removed for servicing of the fixture 20, by engaging an axial end of the cover lens 74 and pulling it downwardly.

Thus the heat sink cover mount members 58, 60 are positioned between the cover lens connecting members 80, so the resilient cover lens arms 78 releasably urge the cover lens connecting members against the heat sink cover mount members, to engage the cover lens concave elements 86 against the heat sink foot convex elements 69. This arrangement on the one hand has the wide length of the entire cover lens to flex, while on the other hand, is tolerant of slight variations in dimension of the heat sink 38 or the cover lens while still forming a secure connection. Moreover, the arrangement provides for significant deflection of the arms 78 and an interference or engagement between the connecting member and the cover mount member engagement of, for example, 0.080 inches. This arrangement allows the cover lens to remain securely affixed despite some variation in size of either the cover lens or the heat sink.

In addition to the cover lens 74, the light of the LEDs may be conditioned by auxiliary lenses 88, shown in FIG. 2. The auxiliary lenses 88 attach to the heat sink over individual LED strips within a particular channel 62 and may be clear, frosted, half-frosted, with a gel color, or other treatment to produce the desired lighting effect. Types of auxiliary lenses include a thin diffusing lens 90 and a collimating lens 92 which tightens the light beam from the LED strip. The auxiliary lenses 88 each have side ribs 94 with sidewardly disposed grooves or recesses 96 which engage with mating side ribs 98 which run the length of the channels 62 along the intermediate walls 64. Different types of auxiliary lenses 88 may be positioned over each channel or some or all channels may be left without any auxiliary lens. The auxiliary lenses 88 may be used in conjunction with one of the cover lenses 70, 74, 76, or they may be used without a cover lens. Fixtures with auxiliary lenses may be used for general illumination, wall grazing, wall washing, and high ceiling downlighting or combinations of these applications.

The different cover lenses may be used in different situations or when different effects are desired. For example the regress cover lens 70 may be used when extra glare control is needed, or simply for its distinctive appearance. The flush cover lens 74 gives a flush appearance to the fixture and works well for general illumination and wall washing. The drop cover lens 76 may be used in T-grid applications, as the lens protrudes from the fixture to more nearly match the surround ceiling tiles. The drop cover lens 76 may also be used simply for its distinctive appearance. It should be noted that the fixture may also be deployed with no cover lens whatsoever.

The fixture is provided with alternative trim elements which finish the appearance of the fixture on either side of the cover lens. For various appearances and applications, a customer may select a flush trim element 100, shown in FIG. 1; a flanged trim element 102, shown in FIGS. 5 and 7; or a mud-in trim element 104, shown in FIG. 6. Each trim element 100, 102, 104 is an extruded aluminum part of constant cross section, generally in the shape of an L, which has an inside member 106 which extends parallel to the side members 24, 26 of the base housing element, and an outside member 108 which extends outwardly from the inside member.

The flush trim element 100 may be used for applications where the fixture does not need to overlap the surrounding surface, for example a wooden surface or a tile surface. In tile applications the fixture can be grouted in with the tile. As shown in FIG. 1, the lower ends of the base housing element 22 side members 24, 26 have downwardly facing trim slots 110 which receive a narrow positioning rib 112 which extends from the outside member 108 of the trim element 100. The inside member 106 of the trim element extends between the base housing element side member and the heat sink 38, and has a narrow mounting rib 114 which extends towards the heat sink. The innermost end of the inside member 106 of the trim element 100 is received within a mounting slot 116 which is formed in the underside of the connecting flange 30 of the base housing element 22. The mounting slot 116 is parallel to the slot 44 and is spaced from it by a land 118. The trim element 100 is removably secured to the base housing element 22 by screw fasteners 120 which engage the trim element mounting rib 114 against the land 118. The fasteners 120 extend into the same slot 48 which receives the fasteners 46 which secure the heat sink to the base housing element flange. The trim element fasteners 120 and the heat sink fasteners 46 are thus offset axially from one another, and the fasteners for each may be spaced about 2 feet apart. It will be noted that although a pair of trim elements 100 is required to finish the opening of the base housing element 22, the same trim element may be used as both a left hand and a right hand finish piece by rotating a trim element about a vertical axis.

The flanged trim element 102, shown in FIGS. 5 and 7, may be used for applications where the fixture requires a flanged trim which extends outwardly to overlap the neighboring surface, for example when the neighboring surface is drywall, or where it is desired too cover a cut opening in wood or tile. The outside member 122 of the flanged trim element 102 extends outwardly beyond the side member of the base housing element.

The mud-in trim element 104, shown in FIG. 6, has a wide but thin outside member 124 which projects beyond the side member of the base housing element and will be employed in drywall installations where the outside member 124 is covered with joint compound or drywall mud to provide a seamless connection between the drywall and the fixture.

As shown in FIG. 7, a cavity 126 is defined on the interior of each base housing element side member 24, 26, running parallel to the side member and extending between an upper slot 127 and a lower slot 129. The cavity 126 receives an optional installation aid 128 which may be used in installing assemblies of multiple fixtures 20 in tight situations. Although each fixture 20 will be supported independently, as described below, it is desirable that multiple fixtures when installed end to end be, as much as possible, flush with one another to present an uninterrupted appearance. The flush appearance may be facilitated by narrow connecting pins or rods 130 which extend through semi-cylindrical slots 132 at the lower ends of the side members 24, 26, positioned above and connecting with the trim slots 110. However, it will be observed that in a constricted installation, for example at the last fixture in a long row of fixtures in a recessed installation, there is not room to preassemble the two side by side pins and the fixture. The installation aid 128 is a narrow plate which is installed within the cavity 126 prior to inserting the fixture 20 next to an already installed fixture. The installation aid can then be gripped from beneath the two adjoining fixtures and extracted from the recess to bridge the gap between the two fixtures and urged into the neighboring cavity to hold the fixtures aligned while the rods 130 are also partially extended from one fixture to the neighboring one.

The base housing element 22 may be provided with corner and median screw bosses 131, as shown in FIG. 7, to receive screws 134 which mount end caps 136 to give a finished end to the fixture. The end caps 136 may be provided in various sizes to neatly finish the ends of the fixture depending on which trim element is used. For example the end cap used with the flanged trim elements may have narrow projections matching the projections of the flanged trim element outside members 122. End caps will be omitted where two fixtures are joined end to end.

The fixture 20 may be mounted through various conventional mounting mechanisms. As shown in FIG. 7, for a recessed installation, for example within a drywall ceiling, conventional galvanized steel hangers 138 may be provided in the ceiling construction, and provided with the shanks of bolt fasteners 139 extending downwardly through spaced top openings 140 in the top member 28 of the base housing element 22. Nuts 142 are attached from the interior of the base housing element 22 which secure it to the hanger 138. Although not illustrated, spaced cables may be secured to the top member 28 of the base housing element with interior grippers, to allow the fixture 20 to be suspended from an overhead attachment of the cables. Similarly, the base housing element 22 may be provided with conventional wall mounting hardware such as a galvanized hanger screwed or welded to the side member of the base housing element, which attaches with screws to a bracket which is mounted to a wall.

Although in the recessed installation regions above the fixture are not required to be illuminated, when the fixture 20 is suspended or mounted to a wall, it may be desirable to direct light upwardly as well as downwardly. The base housing element 22 is configured to accept LED strips and cover lenses to direct light in both directions, as shown in FIG. 1, where an optional top-mounted installation of an LED strip 56 and a collimating lens 92 is shown. The top member 28 of the base housing element 22 has two cover mount members 144 similar to the cover mount members 58, 60 on the heat sink. The upper cover mount members 144 have sidewardly facing convex elements which mate with the concave elements 86 of the cover lens connecting members. Thus any of the cover lenses 70, 74, 76 can be engaged with the cover mount members 144 to overlie LEDs mounted to the top member 28.

It should be noted that while the top and bottom or directions relative to the base housing element are mentioned, the fixture may be installed in various orientations depending on the conditions of the installation. For example, the fixture may be given a recessed installation in a ceiling, in which case it will direct light downwardly, but the same fixture may be given a recessed installation in a floor to direct the light upwardly, or it may be recessed in a vertical wall to direct light sidewardly. Where the fixture is recessed, the portion above the top member 28 may be left unfinished. Alternatively, in a suspended or wall mounted installation, it may be desired to finish the upper surface of the fixture. This may be done with an extruded aluminum lid which has a horizontal surface which extends between the first and second base housing element side members 24, 26.

The modular fixture 20 thus makes it possible for a customer to change the installation approach or application for the fixture in the field. If a customer finds that a fixture must be used in a different way than originally anticipated at the time of placing the order, the manufacturer may be able to ship only a different trim piece, lens, or cover lens, rather than an entirely different fixture.

It is understood that the invention is not limited to the particular construction and arrangement of parts herein illustrated and described, but embraces all such modified forms thereof as come within the scope of the following claims.

We claim:

1. A light fixture comprising:

a base housing element having two spaced side members connected by a top member, wherein portions of the base housing element define a downwardly facing first opening;

a heat sink removably fixed to the base housing element to extend between the base housing element two side members across the first opening, wherein the heat sink has a mounting segment, and a plurality of heat radiating fins extending away from the mounting segment, wherein the mounting segment is spaced below the base housing element top member;

at least one LED mounted to the mounting segment of the heat sink to face downwardly;

portions of the heat sink which define a downwardly extending first cover mount member and a second downwardly extending cover mount member, wherein the first cover mount member is spaced sidewardly from the second cover mount member such that the at least one LED is positioned between the first cover mount member and the second cover mount member, wherein each cover mount member has a leg which extends downwardly from the mounting segment, and a foot which extends sidewardly from the leg, such that the feet project away from one another; and a plastic cover lens having two upwardly extending arms and a central lens element therebetween, wherein the central lens element extends below the at least one LED and the mounting segments, the lens element allowing light from the at least one LED to pass therethrough, wherein each arm has a connecting member which engages one of the heat sink cover mount members, the heat sink cover mount members being thereby positioned between the cover lens connecting members, wherein the arms are resilient and biased inwardly towards the heat sink cover mount members so as to releasably urge the arm connecting members against the heat sink cover mount members.

2. The light fixture of claim 1 wherein each arm has portions defining a sidewardly opening concave element which engages against a sidewardly protruding convex element forming a portion of one of the heat sink cover mount member feet.

3. The light fixture of claim 1 wherein an interior compartment is defined within the base housing element between the top member and the heat sink, and wherein at least one power supply is disposed within the interior compartment and in power supplying relation to the at least one LED.

4. The light fixture of claim 1 further comprising an auxiliary lens connected to the heat sink to extend beneath the at least one LED, the auxiliary lens being positioned between the heat sink and the cover lens.

5. A light fixture comprising:

a base housing element having two spaced side members connected by a top member, wherein portions of the base housing element define a downwardly facing first opening;

a heat sink removably fixed to the base housing element to extend between the base housing element two side members across the first opening, wherein the heat sink has a mounting segment, and a plurality of heat radiating fins extending away from the mounting segment, wherein the mounting segment is spaced below the base housing element top member;

at least one LED mounted to the mounting segment of the heat sink to face downwardly;

portions of the heat sink which define a downwardly extending first cover mount member and a second downwardly extending cover mount member, wherein the first cover mount member is spaced sidewardly from the second cover mount member such that the at least one LED is positioned between the first cover mount member and the second cover mount member, wherein each cover mount member has a leg which extends downwardly from the mounting segment, and a foot which extends sidewardly from the leg, such that the feet project away from one another; and a plastic cover lens with a lens element which extends below the at least one LED and the mounting segments, wherein two arms extend upwardly from and are joined by the lens element, the lens element allowing light from the at least one LED to pass therethrough, wherein each arm has a connecting member which engages one of the heat sink cover mount members, the heat sink cover mount members being thereby positioned between the cover lens connecting members, wherein the arms are resilient so as to releasably urge the cover lens connecting members against the heat sink cover mount members, wherein each base housing element side member has an inwardly projecting connecting flange positioned below the top member, and wherein interior margins of the connecting flanges define the first opening, and wherein the heat sink has first portions positioned beneath associated connecting flanges, and further comprising fasteners which extend between each heat sink first portions and an associated connecting flange to removably secure the heat sink to the base housing element.

6. The light fixture of claim 5 wherein the heat sink plurality of heat radiating fins extend parallel to one another and away from the mounting segment towards the base housing element top member, and wherein each base housing member connecting flange has a slot which receives portions of one of the heat sink heat radiating fins.

7. The light fixture of claim 5 further comprising a trim element having a downwardly extending inside member positioned within the base housing element between one of the base housing element side members and the heat sink, and the trim element inside member adjoining an outwardly extending outside member which underlies the one base housing element side member, the trim element being secured to the base housing element.

8. A light fixture comprising:

a base housing element having two spaced side members connected by a top member, wherein portions of the base housing element define a downwardly facing first opening;

a heat sink removably fixed to the base housing element to extend between the base housing element two side members across the first opening, wherein the heat sink has a mounting segment, and a plurality of heat radiating fins extending away from the mounting segment, wherein the mounting segment is spaced below the base housing element top member;

at least one LED mounted to the mounting segment of the heat sink to face downwardly;

portions of the heat sink which define a downwardly extending first cover mount member and a second downwardly extending cover mount member, wherein the first cover mount member is spaced sidewardly from the second cover mount member such that the at least one LED is positioned between the first cover mount member and the second cover mount member, wherein each cover mount member has a leg which extends downwardly from the mounting segment, and a foot which extends sidewardly from the leg, such that the feet project away from one another;

a plastic cover lens with a lens element which extends below the at least one LED and the mounting segments, wherein two arms extend upwardly from and are joined by the lens element, the lens element allowing light from the at least one LED to pass therethrough, wherein each arm has a connecting member which engages one of the heat sink cover mount members, the heat sink cover mount members being thereby positioned between the cover lens connecting members, wherein the arms are resilient so as to releasably urge the cover lens connecting members against the heat sink cover mount members;

wherein each arm has portions defining a sidewardly opening concave element which engages against a sidewardly protruding convex element forming a portion of one of the heat sink cover mount member feet; and wherein each arm has a flange which extends from the arm towards a heat sink cover mount member foot, and an inlet ramp which extends downwardly and inwardly from the flange to the concave element of the respective lens arm, wherein the inlet ramps engage the heat sink cover mount member convex elements as the cover lens is brought into engagement with the base housing element to deflect the concave elements to bring them into sideward engagement with the convex elements.

9. A light fixture comprising:

a base housing element having two spaced side members connected by a top member, wherein portions of the base housing element define a downwardly facing first opening;

a heat sink removably fixed to the base housing element to extend between the base housing element two side members across the first opening, wherein the heat sink has a mounting segment, and a plurality of heat radiating fins extending away from the mounting segment wherein the mounting segment is spaced below the base housing element top member;

at least one LED mounted to the mounting segment of the heat sink to face downwardly;

portions of the heat sink which define a downwardly extending first cover mount member and a second downwardly extending cover mount member, wherein the first cover mount member is spaced sidewardly from the second cover mount member such that the at least one LED is positioned between the first cover mount member and the second cover mount member, wherein each cover mount member has a leg which extends downwardly from the mounting segment, and a foot which extends sidewardly from the leg, such that the feet project away from one another; and a plastic cover lens with a lens element which extends below the at least one LED and the mounting segments, wherein two arms extend upwardly from and are joined by the lens element, the lens element allowing light from the at least one LED to pass therethrough, wherein each arm has a connecting member which engages one of the heat sink cover mount members, the heat sink cover mount members being thereby positioned between the cover lens connecting members, wherein the arms are resilient so as to releasably urge the cover lens connecting members against the heat sink cover mount members, wherein an intermediate wall extends downwardly from the heat sink mounting member between the first cover mount member and the second cover mount member, and further comprising:

a first axially extending slot formed in portions of the first cover mount member;

a second axially extending slot formed in portions of the intermediate wall; and a lens having portions which engage with the first and second axially extending slots, and positioned below the at least one LED.

10. A light fixture comprising:

a base housing element having two spaced side members connected by a top member, wherein each of the two side members has an inwardly projecting connecting flange positioned below the top member, and wherein interior margins of the connecting flanges define a first opening which opens downwardly;

a heat sink having a mounting segment and wherein the heat sink is releasably connected between the connecting flanges to extend across the first opening; fasteners;

at least one LED mounted to the mounting segment of the heat sink to face downwardly or to the base housing element top member to face upwardly;

portions of the heat sink which define a downwardly extending first cover mount member and a downwardly extending second cover mount member, wherein the first cover mount member is spaced sidewardly from the second cover mount member to define a location for mounting the at least one LED between the first cover mount member and the second cover mount member, wherein each cover mount member has a leg which extends downwardly from the mounting segment, and a foot which extends sidewardly from the leg, such that the feet project away from one another; and portions of the base housing element top member which define a mounting member extending between an upwardly extending third cover mount member and an upwardly extending fourth cover mount member, wherein the third cover mount member is spaced sidewardly from the fourth cover mount member to define a location for mounting the at least one LED between the third cover mount member and the fourth cover mount member, wherein each of the third cover mount member and the fourth cover mount member has a leg which extends upwardly from the top member, and a foot which extends sidewardly from the leg, such that the feet project away from one another; and a plastic cover lens having a lens element of a material which allows light from the at least one LED to pass therethrough, the cover lens having two arms which extend therefrom and are terminated by connecting members which engage one of the cover mount members, the cover lens being thereby releasably associated to the top member or the heat sink, the cover lens arms being resilient so as to releasably urge the cover lens connecting members against the associated cover mount members.

11. The light fixture of claim 10 wherein the heat sink has a plurality of heat radiating fins which extend parallel to one another and away from the mounting segment towards the base housing element top member, and wherein each base housing member connecting flange has a slot which receives portions of one of the heat sink heat radiating fins.

12. The light fixture of claim 10 further comprising a trim element having a downwardly extending inside member positioned within the base housing element between one of the base housing element side members and the heat sink, and the trim element inside member adjoining an outwardly extending outside member which underlies the one base housing element side member, the trim element being secured to the base housing element.

13. The light fixture of claim 10 wherein each cover lens arm has portions defining a sidewardly opening concave element which engages against a sidewardly protruding convex element forming a portion of one of the cover mount member feet.

14. The light fixture of claim 13 wherein each cover lens arm has a flange which extends from the arm towards a cover mount member foot, and an inlet ramp which extends towards the lens and inwardly from the flange to the concave element of the respective lens arm, wherein the inlet ramps engage the cover mount member convex elements as the cover lens is brought into engagement to deflect the concave elements to bring them into sideward engagement with the convex elements.

15. The light fixture of claim 10 wherein an interior compartment is defined within the base housing element between the top member and the heat sink, and wherein at least one power supply is disposed within the interior compartment and in power supplying relation to the at least one LED.

16. The light fixture of claim 10 wherein an intermediate wall extends downwardly from the heat sink mounting member between the first cover mount member and the second cover mount member, and further comprising:

a first axially extending rib formed in portions of the first cover mount member;

a second axially extending rib formed in portions of the intermediate wall; and an auxiliary lens having portions which engage with the first and second axially extending ribs, and positioned below the at least one LED.

17. The light fixture of claim 10 wherein at least one LED is mounted to the base housing element top member mounting member and at least one LED is mounted to the heat sink mounting segment.

18. A light fixture comprising:

a base housing element which is an extrusion having a first side member connected to a second side member by a top member, wherein the first side member and the second side member extend downwardly from the top member, and wherein a first connecting flange extends from the first side member in a transverse direction towards a second connecting flange which extends from the second side member, the connecting flanges being positioned below the top member, wherein a first opening is defined between the first connecting flange and the second connecting flange;

portions of the base housing element first connecting flange which define a first downwardly opening slot, and portions of the second connecting flange which define a second downwardly opening slot which extends parallel to the first downwardly opening slot;

a heat sink having a mounting segment which extends in the transverse direction and a plurality of parallel heat radiating fins which extend upwardly from the mounting segment towards the top member, wherein one of the fins extends into the first downwardly opening slot, and another one of the fins extends into the second downwardly opening slot;

a plurality of first fasteners which extend parallel to the radiating fins and which engage the heat sink fins to the first connecting flange and the second connecting flange so that the heat sink bridges the base housing element first opening;

at least one LED mounted to the heat sink mounting segment or to the top member;

a power supply electrically connected to the at least one LED and positioned between the heat sink and the top member;

portions of the base housing element first connecting flange defining a third downwardly opening slot, parallel to the first downwardly opening slot;

a first trim element having a downwardly extending inside member positioned within the base housing element between the first side member and the heat sink, and the first trim element having an outwardly extending outside member which underlies the first side member; and a second fastener which secures the first trim element to the first connecting flange.

19. The light fixture of claim 18 wherein the first connecting flange has portions defining a fourth downwardly opening slot which is parallel to the third downwardly opening slot, and wherein at least one of the first fasteners extends into the fourth downwardly opening slot, and the second fastener extends into the downwardly opening slot.

20. The light fixture of claim 19 wherein the first trim element has a transversely projecting rib, and wherein the second fastener engages the rib against the first connecting flange to retain the first trim element to the first connecting flange.

21. The light fixture of claim 18 further comprising a second like light fixture, such that two like light fixtures are aligned end to end, and wherein a cavity is defined between the first trim element and the first side member of each of the two aligned light fixtures, and further comprising an installation aid member extending within the cavity to retain the aligned fixtures in alignment.

* * * * *